United States Patent [19]

Mauer

[11] 4,434,690

[45] Mar. 6, 1984

[54] ROTARY PRESS PUNCH RING AND METHOD OF CHANGING PUNCHES CARRIED THEREBY

[75] Inventor: Richard L. Mauer, Fort Lee, N.J.

[73] Assignee: Rapid Ring Co., Inc., East Hanover, N.J.

[21] Appl. No.: 339,749

[22] Filed: Jan. 15, 1982

[51] Int. Cl.[3] ..... B26F 1/00

[52] U.S. Cl. ..... 83/13; 83/345; 83/670; 83/698

[58] Field of Search ..... 83/345, 670, 669, 698, 83/665, 699, 700, 13

[56] References Cited

U.S. PATENT DOCUMENTS

| | | | |
|---|---|---|---|
| 1,739,681 | 12/1929 | Lautenschlager . | |
| 1,887,331 | 11/1932 | Shomaker . | |
| 2,071,414 | 2/1937 | Lowrie . | |
| 2,085,863 | 7/1937 | Lindbom . | |
| 2,116,391 | 5/1938 | Gochoel . | |
| 2,264,134 | 11/1941 | Hawley | 83/345 |
| 2,434,624 | 1/1948 | Peterson . | |
| 3,106,859 | 10/1963 | Huffman . | |
| 3,135,152 | 6/1964 | Bedinghaus | 83/345 |
| 3,194,095 | 7/1965 | Buck et al. | 83/345 X |
| 3,541,656 | 11/1970 | Devon . | |
| 3,602,080 | 8/1971 | Sickel | 83/670 X |
| 3,828,632 | 8/1974 | Grano . | |
| 3,855,890 | 12/1974 | Lynch et al. . | |
| 3,908,499 | 9/1975 | Reed . | |

OTHER PUBLICATIONS

The Hamilton Tool Co., Dwg. 245236, 5/29/74.

*Primary Examiner*—Frank T. Yost

*Attorney, Agent, or Firm*—Lerner, David, Littenberg, Krumholz & Mentlik

[57] ABSTRACT

A rotary press punch ring includes a collar mountable on a shaft of a rotary press and a plurality of punch ring segments, each of which carries a plurality of punches. The punch ring segments are removably and interchangeably attached to the collar so that several punches may be removed and replaced as a group by removing and replacing one of the punch ring segments.

17 Claims, 2 Drawing Figures

ROTARY PRESS PUNCH RING AND METHOD OF CHANGING PUNCHES CARRIED THEREBY

FIELD OF THE INVENTION

Figure 1:
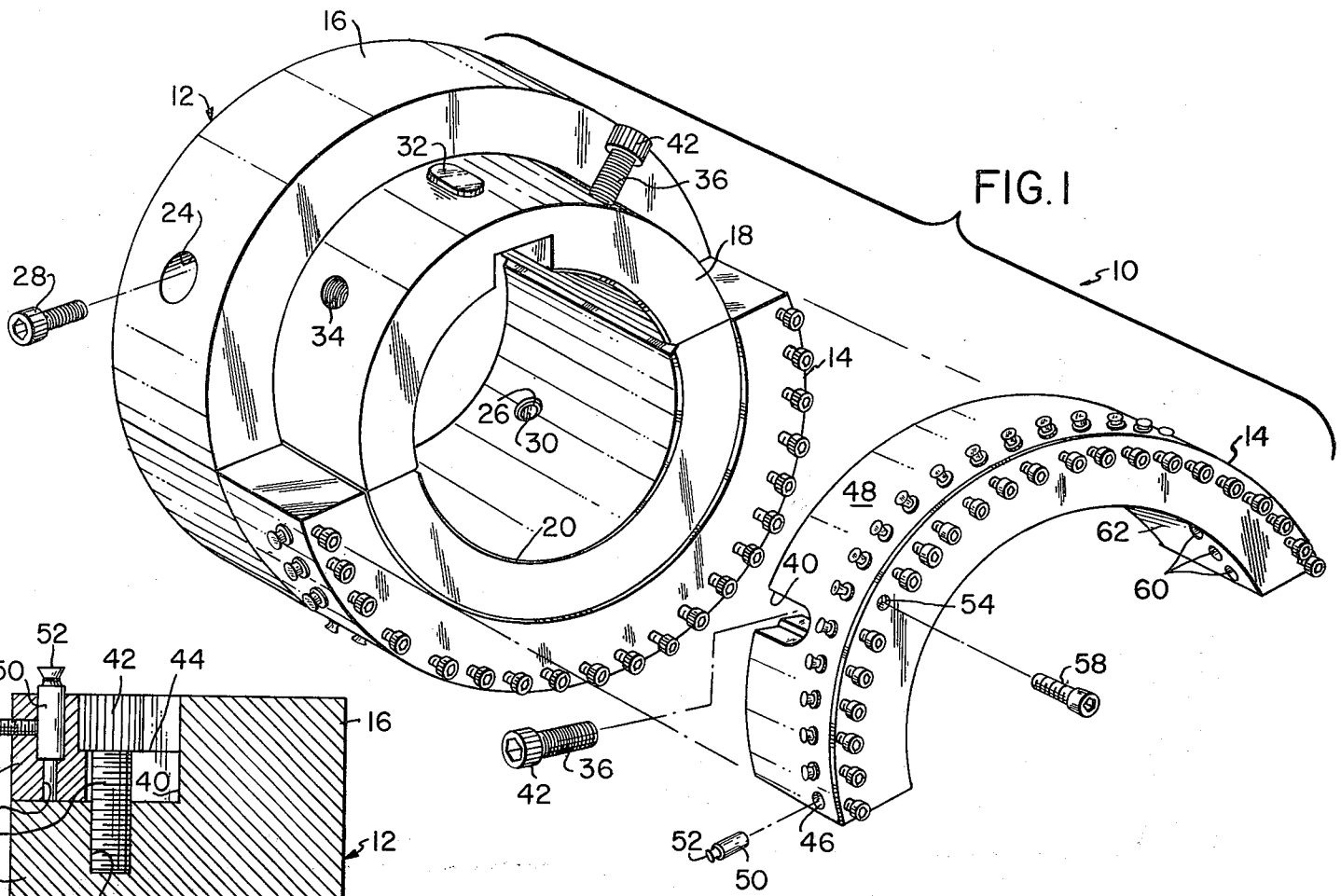

The present invention relates to punches for punching holes in webs or rolls of paper, cardboard or similar material, and, more particularly, to such punches of the rotary type. The punched webs are quite frequently employed by, for instance, computers and other business machines, such as printing calculators.

BACKGROUND OF THE INVENTION

Rotary presses have been developed for punching holes in webs or rolls of paper, cardboard or similar material. Such presses generally include a pair of counter-rotating rings which are positioned such that a strip of paper, cardboard or similar material may be fed between them. One ring carries a plurality of punches which extend radially outwardly from the ring. The periphery of the other ring is provided with a plurality of dies which are sized and spaced apart such that the punches register with and enter respective dies to thereby punch holes in the material being fed between the rings.

In general, the punches are made from a relatively soft steel, while the dies are made from a hardened steel. Thus, if the punches are out of alignment with the dies, the punches can be prematurely worn out. Also, the inherent abrasiveness of the material being fed between the rings causes the punches to be worn out even if they are properly aligned with the dies. Sometimes, only a single punch must be replaced. Other times, an entire set of punch elements must be replaced.

In a vast majority of the prior art rotary presses, the punch rings are made from a pair of half rings which are directly attached to a shaft of the press for rotation therewith. The punches can be replaced individually (see U.S. Pat. No. 3,828,632) or in pairs (see U.S. Pat. No. 3,106,859). Inasmuch as each half ring typically carries as many as twenty-eight or more punches, it is extremely time consuming to change an entire set of punches, regardless of whether they are replaced individually or in pairs. The longer that it takes to replace the punches the longer that the press will be inoperable and therefore unproductive.

At least one known punch ring includes a collar and punch ring segments removably attached to the collar. The punch ring segments are, however, not interchangeable or replaceable with new pre-loaded segments. Thus, like in the other prior art punch rings, the punches cannot be removed and replaced in groups greater than two. Accordingly, it would still be a time-consuming procedure to replace an entire set of punches.

SUMMARY OF THE INVENTION

The problems and disadvantages of the prior art rotary press punch rings described above are overcome by the present invention which relates to a new and improved punch ring including a collar mountable on a shaft of a rotary press for rotation therewith and a plurality of punch ring segments removably and interchangeably attached to the collar. Each of the punch ring segments carries a plurality of removable punches. If only a single punch is damaged, worn or broken, it can be removed and replaced by a new punch without removing any of the punch ring segments from the collar. If, on the other hand, several punches become worn, damaged or broken, one or more of the punch ring segments can be removed from the collar and replaced with an identical punch ring segment or segments equipped with new punches (i.e., pre-loaded punch ring segments). Because the punch ring segments can be detached from the collar without removing the collar from the shaft of the press, an entire set of punches can be replaced by simply removing the punch ring segments and replacing them with new pre-loaded punch ring segments. Because the punch ring segments are removable, the punches on a removed punch ring segment can be replaced while the press is in operation, thereby decreasing the downtime of the press when several of the punches have to be replaced. The interchangeability of the punch ring segments permits a removed punch ring segment to be provided with new punches and then reattached to the collar as a replacement for another punch ring segment.

The punch ring segments can be used interchangeably with various collars. Thus, if one press has a shaft with a first diameter and a second press has a shaft with a second diameter, there would no need to provide two completely different punch rings. Rather, it would only be necessary to provide two different collars, one for each press, inasmuch as the punch ring segments could be used interchangeably with the two collars.

Because the collars can also be used interchangeably with different diameter punch ring segments, there is no need to provide a completely new punch ring if, for instance, the size (i.e., diameter) of the punch ring or the spacing between punches is to be changed. Rather, only the punch ring segments would have to be replaced.

In one embodiment, the punches are releaseably received in openings provided in an outer circumferential surface of the punch ring segments. By providing an inner circumferential surface of the punch ring segments with access holes which communicate with the openings in the outer circumferential surface of the punch ring segments, the punches can be pushed out of the openings if necessary (i.e., if, for instance, the head of a punch element is sheared off or worn off).

BRIEF DESCRPITION OF THE DRAWINGS

Figure 2:
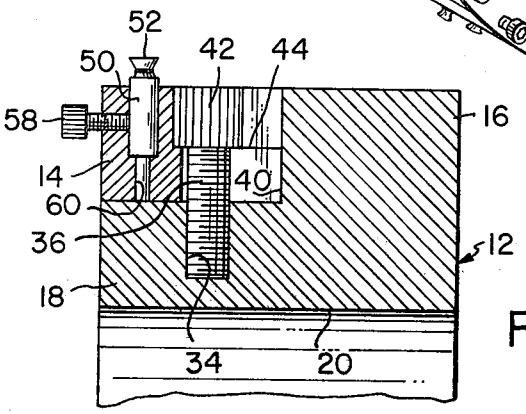

For a more complete understanding of the present invention reference may be had to the following detailed description of an exemplary embodiment considered in conjunction with the attached drawing, in which:

FIG. 1 is a partially exploded view of a rotary press punch ring constructed in accordance with the present invention; and FIG. 2 is a partial cross-sectional view of the rotary press punch ring of FIG. 1.

DESCRIPTION OF AN EXEMPLARY EMBODIMENT

Referring to FIGS. 1 and 2, there is shown a rotary press punch ring 10 including a split collar 12 and a pair of punch ring segments 14 removably attached to the collar 12. The collar 12 has a large diameter section 16 and a small diameter section 18. A bore 20 extends through the large and small diameter sections 16, 18 of the collar 12. The bore 20 is sized and shaped so as to receive a shaft (not shown) of a rotary press. The collar 12 also has a key way 22 which communicates with the bore 20. The key way 22 is sized and shaped so as to receive a key (not shown) carried by the shaft of the press. The key and key way 22 cooperate to align and drive the punch ring 10.

The large diameter section 16 of the collar 12 is provided with two threaded holes 24, 26. The hole 24 communicates with the key way 22 and threadedly receives a set screw 28, which locks the punch ring 10 in position on the shaft of the press. The hole 26 communicates with the bore 20 and threadedly receives a brass-tipped set screw 30, which also locks the punch ring 10 in position on the shaft of the press.

Two locating keys 32 (only one of which is visible in FIG. 1) are provided on diametrically opposite portions of the small diameter section 18 of the collar 12. The locating keys 32 cooperate with locating key ways (not shown) formed in the punch ring segments 14 to locate the punch ring segments 14 on the collar 12. The small diameter section 18 of the collar 12 is also provided with four threaded holes 34 (only one of which is visible in FIG. 1). The holes 34 threadedly receive bolts 36 which function to lock the punch ring segments 14 to the collar 12.

An inner sidewall 38 of each of the punch ring segments 14 is provided with a pair of slots 40, each of which can be aligned with a corresponding one of the holes 34 and hence a corresponding one of the bolts 36. Each of the bolts 36 has a head 42 which rests on a U-shaped ledge 44 formed in a corresponding one of the slots 40 when the bolts 36 are screwed into the holes 34 to attach the punch ring segments 14 to the collar 12.

Each of the punch ring segments 14 includes a plurality of openings 46 provided in an outer circumferential surface 48 thereof for removably receiving a plurality of punches 50. Each of the punches 50 has a head 52 which extends outwardly beyond the outer circumferential surface 48 of a corresponding one of the punch ring segments 14. A plurality of threaded apertures 54 is provided in an outer sidewall 56 of each of the punch ring segments 14. Each of the apertures 54 communicates with a corresponding one of openings 46. Set screws 58 are threadedly received in the apertures 54 for releaseably locking the punches 50 in place.

A plurality of access openings 60 is provided in an inner circumferential surface 62 of each of the punch ring segments 14. Each of the access openings 60 communicates with a corresponding one of the openings 46 in the outer circumferential surface 48 of the punch ring segments 14. The access openings 60 are large enough to receive an object, such as a slender rod, for pushing one of the punches 50 out of its corresponding opening 46 if, for instance, its head 52 has been sheared off or worn off.

If only one of the punches 50 is damaged, worn or broken, it can be removed and replaced by backing out a corresponding one of the set screws 58. Inasmuch as the set screws 58 can be backed off without removing the punch ring segments 14 from the collar 12, the replacement of one or more of the punches 50 can be accomplished without removing the punch ring segments 14 from the collar 12.

If a number of punches 50 must be replaced, two or more of the bolts 36 can be backed out of their corresponding holes 34 to permit one or both of the punch ring segments 14 to be slid off of the small diameter section 18 of the collar 12. Once the punch ring segments 14 have been removed from the collar 12, they can be immediately replaced by another pair of punch rings segments (not shown) which are provided with new punches. During the operation of the punch ring 10 with the new punch ring segments, all of the punches 50 carried by the removed punch ring segments 14 may be replaced so that the punch ring segments 14 can be employed as replacements for the new punch ring segments when their punches become worn damaged or broken. Moreover, because the punch ring segments 14 are interchangeable, one can be used as a replacement for the other and vice versa.

It will be understood that the embodiment described herein is merely exemplary and that a person skilled in the art may make many variations and modifications without departing from the spirit and scope of the invention. For instance, each of the punch ring segments 14 could be provided with a double row of punches 50. Also, the number, size and configuration of the punches 50 can be varied from job to job. All such modifications and variations are intended to be included within the scope of the invention as defined in the appended claims.

I claim:

1. A rotary press punch ring, comprising a collar mountable on a shaft of a rotary press for rotation therewith, a plurality of punch ring segments, each punch ring segment having an outer circumferential surface which forms at least a part of an outer circumferential surface of said rotary press punch ring, attaching means provided in said outer circumferential surface of each of said punch ring segments for removably and interchangeably attaching each of said punch ring segments to said collar independently of the other punch ring segment or segments, said attaching means including at least one fastener for each punch ring segment, each fastener extending through it cooresponding punch ring segment into engagement with said collar, and receiving means provided in said outer circumferential surface of each of said punch ring segments for releasably receiving several punches per punch ring segment, whereby several punches may be collectively removed and replaced as a group by removing and replacing one of said punch ring segments without removing or otherwise disturbing the other punch ring segment or segments.

2. A rotary press punch ring according to claim 1 wherein said receiving means includes a plurality of openings provided in said outer circumferential surface of each of said punch ring segments, each opening releaseably receiving a corresponding punch.

3. A rotary press punch ring according to claim 2, further comprising locking means for releaseably locking each of said punches in its corresponding opening.

4. A rotary press punch ring according to claim 3, wherein said locking means individually locks each of said punches in its corresponding opening, whereby said punches may be individually removed and replaced without removing any of said punch ring segments from said collar.

5. A rotary press punch ring according to claim 2, further comprising providing means for providing access to each of said openings in said punch ring segments, whereby said punches can be pushed out of said openings.

6. A rotary press punch ring according to claim 1 wherein said punch ring segments form an annular punch ring.

7. A rotary press punch ring according to claim 6, wherein said ring is formed from two substantially identical punch ring segments arranged in end-to-end fashion.

8. A rotary press punch ring according to claim 1, wherein each fastener is a bolt.

9. A rotary press punch ring according to claim 1, further comprising locating means for locating each of said punch ring segments on said collar, said locating means inhibiting movement of said punch ring segments in a generally axial direction relative to said shaft of said press while permitting said punch ring segments to be moved away from said collar in a generally radial direction relative to said shaft of said press.

10. A rotary press punch ring according to claim 9, wherein said locating means also inhibits said punch ring segments from rotating relative to said collar.

11. A rotary press punch ring according to claim 10, wherein said locating means includes a plurality of keys formed on said collar and a plurality of key ways formed in said punch ring segments, each punch ring segment being provided with at least one key way and each key way being sized and located so as to receive a corresponding one of said keys.

12. A rotary press punch ring according to claim 1, wherein said punches are equally spaced around said outer circumferential surface of each of said punch ring segments.

13. A method of changing punches carried by a rotary press punch ring which includes a collar mounted on a shaft of a rotary press for rotation therewith, a plurality of punch ring segments, each punch ring segment having an outer circumferential surface which forms at least a part of an outer circumferential surface of said rotary press punch ring, attaching means provided in said outer circumferential surface of each of said punch ring segments for removably and interchangeably attaching each of said punch ring segments to said collar independently of the other punch ring segment or segments, said attaching means including at least one fastener for each punch ring segment, each fastener extending through its corresponding punch ring segment into engagement with said collar, and receiving means provided in said outer circumferential surface of each of said punch ring segments for releaseably receiving several punches per punch ring segment, said method comprising the steps of disengaging said fastener or fasteners of one of said punch ring segments from said collar by moving said fastener or fasteners away from said outer circumferential surface of said one punch ring segment in a generally radial direction relative to said shaft of said press, removing said one punch ring segment from said collar by moving said one punch ring segment away from said collar in a generally radial direction relative to said shaft of said press without removing or otherwise disturbing the other punch ring segment or segments, whereby the several punches on said one punch ring segment may be collectively removed from said press as a group, and then replacing said one punch ring segment with an identical punch ring segment equipped with several new punches.

14. A method according to claim 13 further comprising the step of replacing any worn punches carried by said one punch ring segment with new punches after said one punch ring segment has been removed from said collar.

15. A method according to claim 14, further comprising the steps of removing another of said punch ring segments and replacing it with said one punch ring segment provided with several new punches.

16. A method according to claim 13, further comprising the step of removing the other punch ring segment or segments from said collar and then replacing each removed punch ring segment with an identical punch ring segment which is equipped with several new punches.

17. A method according to claim 16, further comprising the step of replacing any worn punches carried by each removed punch ring segment with new punches after the removal of said punch ring segments from said collar.

* * * * *